United States Patent [19]

O'Connor

[11] 4,089,356

[45] May 16, 1978

[54] FIBER-REINFORCED PLASTIC TOOL HANDLE

[76] Inventor: Dennis J. O'Connor, 11175 Houston St. Apt. #1, North Hollywood, Calif. 91601

[21] Appl. No.: 655,862

[22] Filed: Feb. 6, 1976

[51] Int. Cl.[2] ..... B25G 3/10

[52] U.S. Cl. ..... 145/29 R; 145/2 R; 145/29 B; 145/61 R; 145/61 C; 145/61 F; 145/61 M

[58] Field of Search ..... 145/29 R, 36, 29 B, 145/61 M, 61 F, 61 C, 61 R, 2 R

[56] References Cited

U.S. PATENT DOCUMENTS

| | | | |
|---|---|---|---|
| 1,144,035 | 6/1915 | Guy et al. | 145/29 R |
| 1,565,668 | 12/1925 | Nicholls | 145/29 R |
| 2,757,694 | 8/1956 | Curtis | 145/29 R |
| 3,578,825 | 5/1971 | Merrow | 145/29 R |
| 3,844,321 | 10/1974 | Cook | 145/29 R |

FOREIGN PATENT DOCUMENTS

| | | | |
|---|---|---|---|
| 125,870 | 10/1947 | Australia | 145/61 R |

*Primary Examiner*—James L. Jones, Jr.
*Assistant Examiner*—J. T. Zatarga
*Attorney, Agent, or Firm*—Blakely, Sokoloff, Taylor & Zafman

[57] ABSTRACT

A fiber-reinforced plastic tool handle for engaging a handle receiving aperture of a tool, such as the eye of a hammer. A plurality of elongated fiber-reinforced plastic members or shafts are used to define the handle, allowing the handle to be readily secured in the aperture with a wedge.

11 Claims, 10 Drawing Figures

Fig. 6
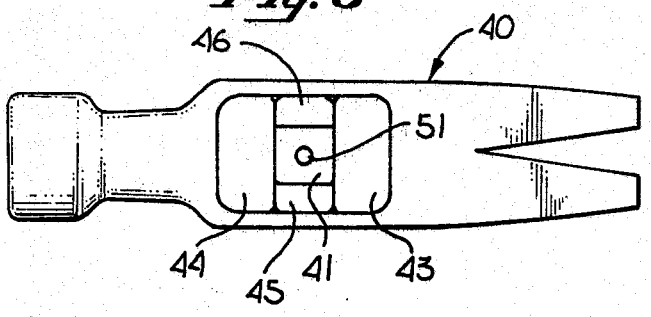
Fig. 9
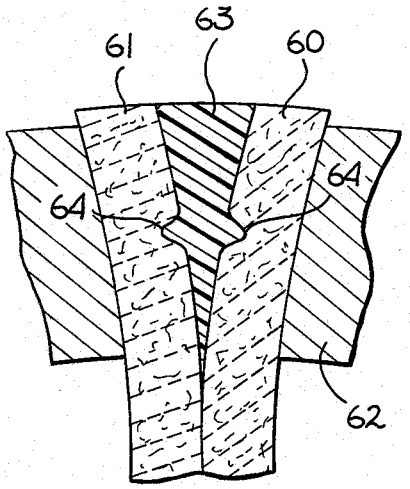
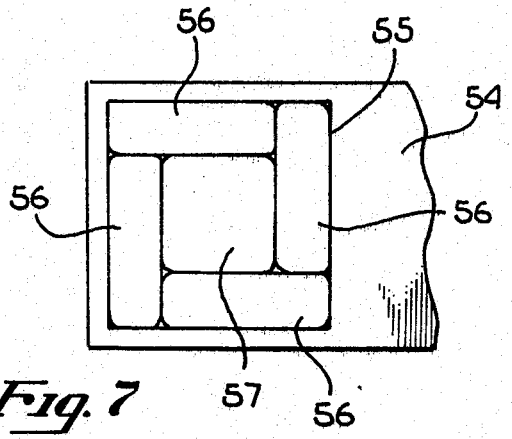
Fig. 7
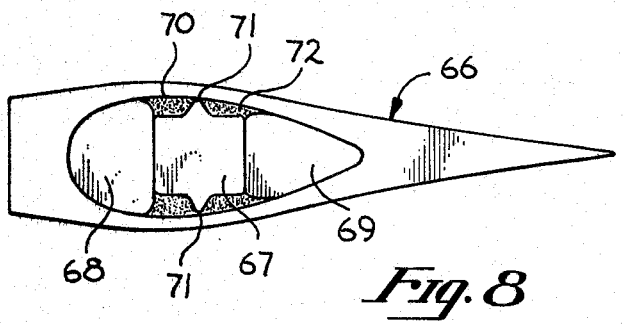
Fig. 8
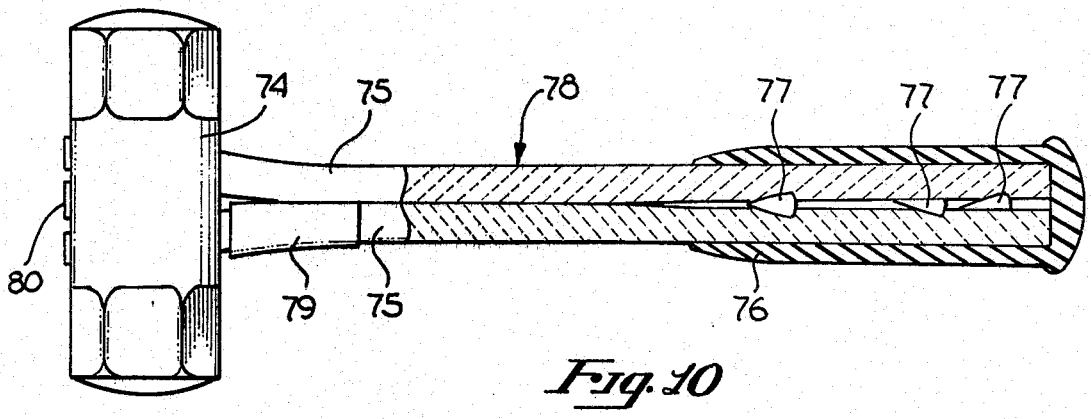
Fig. 10

FIBER-REINFORCED PLASTIC TOOL HANDLE

BACKGROUND OF THE INVENTION

1. Field of the Invention

The invention relates to the field of fiber-reinforced plastic tool handles, such as hammer handles.

2. Prior Art

Hickory and ash have been among the most popular hardwoods employed for tool handles. Typically, the tool-end of the wooden handle is split in the eye of the tool with a metal wedge. This forces the wood against the tool, securing the handle in the eye. Even though such handles have been used for generations they do not have numerous problems. First, wood breaks relatively easily when the handle strikes the target (referred to as an overblow). When the handle breaks the tool may cause damage since it may completely leave the control of its user. Secondly, dimensions of tool eyes are seldom consistent, even for tools produced by the same forging tool, since such forging tools wear in use. Thus, the size of the wedge and the depth to which it is driven may vary for tools produced by a single forge. For an oversized eye, if the wedge is driven to its normal depth the tool will not be secure. However, if the wedge is driven-in sufficiently to secure the tool, the handle may split. Moreover, the selected hard-woods needed for wooden handles are a scarce resource.

In more recent years single shafts of fiberglass have been used for tool handles. In most cases, the handle is inserted into the eye, and then secured with epoxy, or the like. However, since the dimensions of the eyes vary, securing the handle to the tool with epoxy is not an easy manufacturing step. The problems associated with using a wedge with fiberglass tool handles are discussed in U.S. Pat. No. 3,578,825 (Column 1). In some cases a wedge will cause the handle to split, and vibrations from normal use will propagate the fracture down the handle. More complicated, fiberglass handles have been fabricated to reduce handle weight and to provide a handle that will accept a wedge. (See U.S. Pat. No. 3,613,753). Still others have employed special adapters for interfacing between the fiberglass tool handle and tool. (See U.S. Pat. No. 3,753,602).

As will be seen the present invention employs a plurality of elongated members to define the tool handle. This enables the handle to more fully engage the eye and permits use of wedges, moreover the handle will fit a large range of eyehole variations. The only prior art known to the application that utilizes a plurality of numbers for a handle is shown in U.S. Pat. No. 2,435,556. However, in this patent, metal and wood files are used for the handle to form a multi-purpose tool, and these members are bolted to the striking tool.

SUMMARY OF THE INVENTION

A tool handle for use in a tool having a handle receiving aperture, such as the eye of a hammer, is described. A plurality of elongated fiber-reinforced plastic members are used to define the handle. A wedge is used to force the plurality of members against the walls of the aperture, thereby securing the tool to the handle. Lockwires, or other locking means, are employed as a safety device to assure retention of the wedge between the members. A grip fabricated of resilient material is disposed about the butt end of the members. Detuning spacers may be employed between the members, spaced apart from the aperture engaging portion of the handle, to reduce vibrations in the handle. These spacers are used to attenuate the vibrations that are transmitted along the length of the handle under normal use. These vibrations in prior art handles cause discomfort and fatigue to the hand and arm of the user. In prior art handles, particularly those comprising a single member, such attenuation of vibrations or detuning is impractical.

One object of the present invention is to provide a fiber-reinforced plastic tool handle which is easily installed in the eye or socket of a tool and which may be wedged in place.

Another object of the invention is to provide a fiberglass tool handle which may be used in handle receiving apertures of tools where the dimensions of such apertures vary from tool-to-tool.

Still another object of the present invention is to provide a tool handle, that when broken by a severe over-blow remains attached to the tool.

Another object of the invention is to provide a tool handle which includes means for attenuating vibrations in the handle.

Yet another object of the present invention is to provide a tool handle, sections of which may be easily cut to any desired length and readily reused (or reversed) when damages occur to other sections of the handle.

BRIEF DESCRIPTION OF THE DRAWINGS

FIG. 6 is a top plan view of a hammer head illustrating another embodiment wherein four shafts are used to fabricate the hammer handle.

FIG. 7 is a plan view of the top of a tool illustrating an embodiment where four rectangular shafts are used to define the tool handle in a square eyehold such an in an adz.

FIG. 8 is an alternate embodiment of the present invention, illustrating a top plan view of a tool wherein two shafts are used to define the handle, and wherein the wedge includes deformable projections.

FIG. 9 is a cutaway partial side view of an alternate embodiment of a tool handle and tool wherein the wedge includes a locking ridge; and FIG. 10 is a side view of a sledge hammer illustrating the invented handle which includes an over-blow shield.

DETAILED DESCRIPTION OF THE INVENTION

Figure 1:
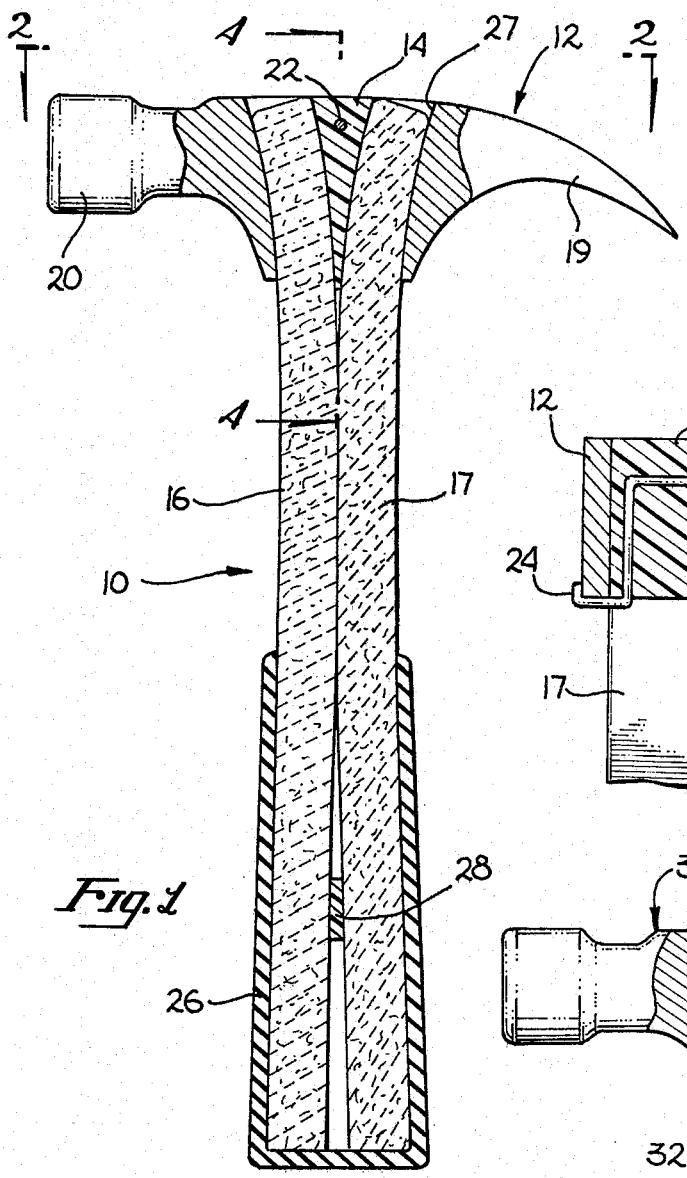
FIG. 1 is a side view of a hammer utilizing the invented handle with a portion of the hammer head and handle being cutaway to illustrate the wedges and grip utilized in the presently preferred embodiment.
Figure 3:
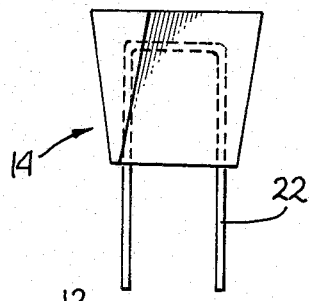
FIG. 3 is a side view of the wedge used to retain the handle illustrated in FIGS. 1 and 2 within the eye of the hammer head. A portion of the wedge is cutaway to illustrate the locking wire.

The present invention discloses a unique handle for a tool, such as a hammer, or other tool, wherein a plurality of of elongated fiber reinforced plastic members are used to define the handle. A wedge is used with the shafts to secure the handle to the handle receiving aperture of the tool, such as the eye or socket of a hammer head. While the presently preferred embodiment is described in conjunction with a claw hammer, it will be appreciated that other tools, other than hammers, may be utilized with the disclosed tool handle.

Referring now to FIGS. 1, 2, 3 and 4, a hammer head 12 is illustrated and includes a striking end 20 and a claw end 19. The hammer head 12 defines an eye 27 for receiving a handle. The handle 10, in its presently preferred embodiment, includes two elongated shafts 16 abd 17 both of which (as may be best seen in FIG. 2, have cross-section adaptable for conforming to the shape of the eye 27. These members comprise fiber reinforced plastic, such as molded fiberglass or pultruded fiberglass.

Figure 4:
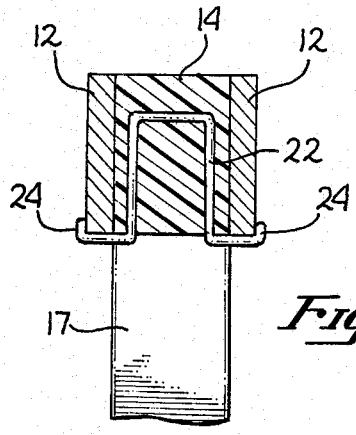
FIG. 4 is a partial cutaway end view of the hammer of FIG. 1 taken through section line 4—4 of FIG. 1; this view illustrates the locking wire of the wedge.

A wedge 14 is disposed between the shafts 16 and 17, and is used to force the shafts into secure engagement with the hammer head 12. The wedge 14, as may be best seen in FIG. 3, includes a locking wire 22 disposed within the interior of the wedge 14. The wedge 14 may be a metal or wooden member or a suitably hard plastic member. After the wedge is driven between the shafts 16 and 17 the ends 24 of the locking wire are bent around the exterior of the hammer head 12 to secure the wedge in place as is best illustrated in FIG. 4. While the wedge itself serves to secure the shafts within the hammer head eye, the locking wire or other locking means provides an additional safety means for securing the handle and tool.

A grip 26 is disposed about the butt end of the handle 10 around shafts 16 and 17. In the presently preferred embodiment the grip 26 comprises a rubber, or other resilient member, tightly secured (mechanically or chemically) about the shaft 16 and 17.

A detuning spacer 28 is disposed between the shafts, spaced apart from the hammer head 12. This spacer is used to provide separation between the shafts so that the grip 26 remains secure on the shafts, and also for detuning the hammer handle. The exact position of the spacer 28 is generally determined empirically, and is placed in a position so as to prevent propagation of vibrations in the handle 10 when, by way of example, the hammer is used to drive nails, or the like. The resilient detuning spacer 28 may be a rubber or plastic member, or the spacer 28 may be an integral part of the grip. Without the spacer the handle tends to vibrate at its natural frequency, much like a tuning fork. This occurs in prior art handles causing fatigue and discomfort to the user, particularly in steel shafts. However, with the use of one or more spacers these vibrations are attenuated and dampened making the handle more comfortable to use.

Figure 5:
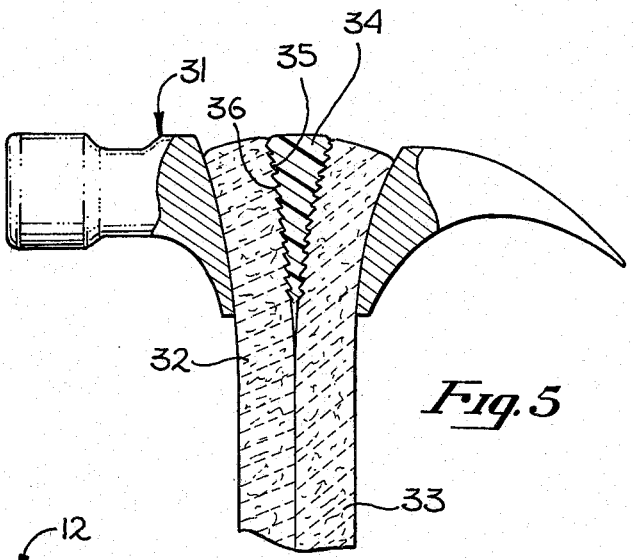
FIG. 5 is a partial cross-section of a hammer head and handle illustrating an alternate embodiment wherein a serrated wedge is utilized.
Figure 2:
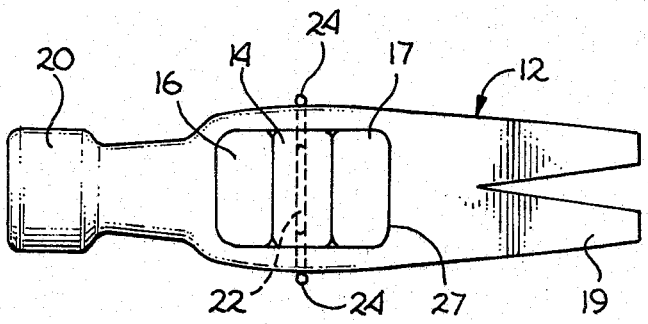
FIG. 2 is a top plan view of the hammer of FIG. 1 taken through section line 2—2 of FIG. 1.

Referring to FIG. 5, where an alternate embodiment of the present invention is illustrated, a hammer head 31 is shown which includes a striking surface and a claw end. A handle comprising two elongated fiber-reinforced plastic members 32 and 33 similar to the previous embodiment is utilized. The butt end of the handle (not illustrated) includes a grip member similar to the grip 26 of FIG. 1. In this embodiment a wedge 34 which again may comprise a metal, wooden, or a suitable plastic member includes serrated, tapered surfaces 35 which are used for engaging corresponding serrated surfaces 36 of the members 32 and 33. In this embodiment the locking wire 22 used in the embodiment shown in FIGS. 1 through 4 is not required since the serrations of the wedge 34, and serrations on the upper portion of the members 32 and 33, secure the wedge in place, and hence allow the members 32 and 33 to remain secure within the eye of the hammer head 31.

In FIG. 6 a hammer head 40 is illustrated which utilizes a handle comprising four elongated, generally rectangular shafts 43, 44, 45 and 46. The shafts 43 and 44 are made to fully engage opposite ends of the eye of hammer head 40, while the shafts 45 and 46 are disposed between shafts 43 and 44 and engage the sides of the eye of hammer head 40. A generally square shaped wedge 41 is driven between the four shafts causing the shafts to engage the eye of the hammer head 40. In this embodiment a aperture 51 is disposed through the wedge 41 to allow a nut and bolt or the like to secure and tighten the wedge. The bolt includes a T shaped head which engages the lower edges of the eye. Epoxy may be placed about each of the shafts 43, 44, 45 and 46 in the area where the shafts engage the eye of hammer head 40. When the wedge 41 is driven into place the epoxy secures the wedge 41 in place.

In FIG. 7 a tool 54 is illustrated which defines a generally square socket 55. Four elongated fiber-reinforced plastic shafts 56, each of which include retangular cross-sections are utilized in conjunction with a wedge 57. In this embodiment, as in the embodiment of FIG. 6, the use of four shafts allows the entire surface of the socket 55 to be in contact with a shaft used to form the handle. Any one of a plurality of locking means may be used to secure the wedge 57 in place, such as epoxy, a locking wire, a nut and bolt, or the like.

In FIG. 8 a hatched head 66 is illustrated which defines a tool receiving socket 70. Two fiber reinforced plastic shafts 68 and 69 are utilized to define a handle, each shaft is shaped to engage an opposite end of the socket 70. A wedge 67 which includes two deformable projections 71 is driven between the parallel surfaces of shafts 68 and 69; the remaining volume of the socket 55 is filled with epoxy 72. In this embodiment the projections 71 are deformable and, in fact, are deformed as the wedge 67 is driven between the shafts 68 and 69. The projections 71 assure that the wedge 67 will remain centered within socket 72, thus allowing ample volume on both sides of the wedge for epoxy, or the like. The wedge 67 may be made from a soft metal, plastic, wood or the like.

In FIG. 9, a partial section of a tool 62 which defines an aperture is illustrated. A pair of shafts 60 and 61 are engaging this aperture, are secured in place by a wedge 63. This wedge includes a pair of ridges 64 which engage a pair of grooves, one defined in each shaft 60 and 61. When the wedge is driven into place, the ridges engage the grooves thereby securing the wedge in place.

In FIG. 10 a final embodiment of the present invention is illustrated which includes a sledge hammer having a hammer head 74 and a handle 78. The handle comprises two elongated shafts 75 which are secured within the eye of the hammer head 74 by a wedge 80. A plurality of detuning spacers 77 are disposed between the shafts 75 within a grip 76. The grip 76 may be secured in place on the shaft 77 with epoxy, or the like. In this embodiment a shield 79, which may be a sleeve disposed about one of the shafts 75 is placed on a shaft 75 adjacent to the hammer head 74. The over-blow shield 79 is used to protect the shaft 75 from an over-blow. Over-blows are the single largest cause of hammer handle failures.

As is apparent with the presently disclosed handle, since a plurality of shafts are utilized a simple wedge may be driven between the shafts to secure the handle in place. In prior art handles where a single fiberglass shaft was utilized it was difficult, at best, to utilize a wedge. With the use of a wedge in the present invention the irregularity in dimensions of hammer head eyes, or other tool head sockets, becomes less critical. Thus, the presently disclosed handle may be utilized even though the dimensions of the apertures for receiving the handle vary from tool-to-tool. Also where a plurality of shafts are used to define a handle the handle itself may more readily be made to conform to the shape of the tool receiving aperture. Unlike other prior art fiberglass handles, if damage should occur to a handle, the shafts may be reused by cutting off the damaged portion, and reinserting the usable portion within a tool receiving aperture. This is particularly useful where a longer handle, once damaged, may be used as a shorter handle in another application, or with the same tool. Another advantage to the disclosed handle is that when the handle is subject to an over-blow which breaks the handle, typically only a single shaft of the handle will be broken. The other shaft or shafts may be reused. Also, since typically only a single shaft breaks, the remaining shaft or shafts hold the tool to the handle, thus preventing possible physical injury.

Another advantage to the presently disclosed handle is that since the handle comprises a plurality of shafts detuning spaces may be readily disposed between the shafts. This allows vibrations in the handle to be reduced.

Thus, a novel tool handle has been disclosed which comprises a plurality of elongated fiber-reinforced plastic members. The handle may be easily secured to the handle receiving aperture of a tool without special equipment and without the costly, time consuming use of epoxy used in the prior art.

I claim:

1. In a tool having a tool head with a handle receiving aperture, an improved handle for engaging said aperture comprising:

a plurality of separate, elongated, solid plastic members having reinforcing fibers uniformly distributed therein, each of said members having an upper tool engaging end, a lower butt end and a central portion merging with said upper and lower ends, said upper tool receiving end of said members being disposed within said tool head aperture;

locking means disposed on said upper tool receiving ends of said members for securing each of said members upper end to said tool head;

said central portion of each member being in confronting non-fixed relationship to each other;

grip means disposed on said lower butt end of each of said members for providing a grip and for securing said butt ends;

spacer means frictionally positioned between said members below said tool head for reducing vibration during use;

whereby a plurality of members may be readily secured within said aperture of said tool.

2. The improved handle defined by claim 1 wherein said tool is a hammer.

3. The improved handle defined by claim 1 wherein said locking means comprise a wedge, disposed between said plurality of members.

4. The improved handle defined by claim 3 wherein said wedge includes a locking wire disposed within said wedge and having terminal ends extending outwardly to the bottom of said tool head for securing said wedge to said tool head.

5. The improved handle defined by claim 3 wherein said wedge includes at least one serrated surface for engaging a corresponding serrated surface of at least one of said members.

6. The improved handle defined by claim 3 including epoxy for securing said wedge in position.

7. The improved handle defined by claim 1 wherein two elongated members are employed.

8. The improved handle defined by claim 7 wherein said locking means comprises a wedge disposed between said two member at said tool receiving end of said members.

9. The improved handle defined by claim 8 including at least one spacer member disposed between said elongated members, spaced apart from said tool, for lessening vibrations in said handle.

10. The improved handle defined by claim 9 wherein an over-blow shield is mounted on at least one of said elongated members.

11. The improved handle defined by claim 1 wherein said elongated members comprise pultruded fiberglass members.

* * * * *